US011335311B2

(12) United States Patent
Mei et al.

(10) Patent No.: US 11,335,311 B2
(45) Date of Patent: May 17, 2022

(54) BROADBAND ULTRATHIN ACOUSTIC WAVE DIFFUSION STRUCTURE

(71) Applicant: Dalian University of Technology, Dalian (CN)

(72) Inventors: Yulin Mei, Dalian (CN); Xiaoming Wang, Dalian (CN); Yixuan Mei, Dalian (CN)

(73) Assignee: Dalian University of Technology, Dalian (CN)

( * ) Notice: Subject to any disclaimer, the term of this patent is extended or adjusted under 35 U.S.C. 154(b) by 416 days.

(21) Appl. No.: 16/487,389

(22) PCT Filed: Apr. 26, 2017

(86) PCT No.: PCT/CN2017/082072

§ 371 (c)(1),
(2) Date: Aug. 20, 2019

(87) PCT Pub. No.: WO2018/195835

PCT Pub. Date: Nov. 1, 2018

(65) Prior Publication Data

US 2019/0378488 A1 Dec. 12, 2019

(51) Int. Cl.
*G10K 11/162* (2006.01)
*G10K 11/20* (2006.01)

(52) U.S. Cl.
CPC ..... *G10K 11/162* (2013.01); *G10K 11/20* (2013.01)

(58) Field of Classification Search
CPC ..... G10K 11/162; G10K 11/20
(Continued)

(56) References Cited

U.S. PATENT DOCUMENTS 3,901,352 A * 8/1975 Cluzel ..... G10K 11/205 181/175
7,520,369 B2 * 4/2009 Dravet ..... B64D 29/00 181/284

(Continued)

FOREIGN PATENT DOCUMENTS

CN 102251829 A 11/2011
CN 102689477 A 9/2012

(Continued)

*Primary Examiner* — Forrest M Phillips
(74) *Attorney, Agent, or Firm* — Muncy, Geissler, Olds & Lowe, P.C.

(57) ABSTRACT

A broadband ultrathin acoustic wave diffusion structure has a plurality of acoustic wave diffusion units. Each acoustic wave diffusion unit has at least one acoustic wave propagation section, and an acoustic wave focused section communicating with the acoustic wave propagation section is arranged according to needs. The acoustic wave focused section is formed by an acoustic wave focused cavity filled with acoustic material. The acoustic wave focused cavity is a variable-section cavity. The acoustic wave propagation section is formed by a simply connected acoustic wave propagation passage with a close end. Different acoustic wave diffusion units have different lengths of the simply connected acoustic wave propagation passages. The maximum length of the simply connected acoustic wave propagation passage may be dozens or even hundreds of times of the thickness of the acoustic wave diffusion structure, which can meet the diffusion requirements for low frequency acoustic waves to the maximum extent.

12 Claims, 6 Drawing Sheets

(58) Field of Classification Search
USPC ..... 181/286
See application file for complete search history.

(56) References Cited

U.S. PATENT DOCUMENTS

| | | | | |
|---|---|---|---|---|
| 11,164,559 | B2 * | 11/2021 | Lee | G10K 11/162 |
| 2010/0089691 | A1 * | 4/2010 | Nakamura | B60R 13/011 181/286 |

FOREIGN PATENT DOCUMENTS

| | | | |
|---|---|---|---|
| CN | 106382432 | A | 2/2017 |
| CN | 107071663 | A | 8/2017 |
| SU | 1420198 | A1 | 8/1988 |

* cited by examiner

BROADBAND ULTRATHIN ACOUSTIC WAVE DIFFUSION STRUCTURE

TECHNICAL FIELD

The present invention belongs to the technical field of sound engineering, and relates to a broadband ultrathin acoustic wave diffusion structure.

BACKGROUND

Since Schroeder diffuser came out in 1970s, it has been widely used in the technical field of sound engineering, especially in music halls, theaters and other places with high sound requirements. Schroeder diffuser disperses sound energy by reflecting sound to different directions to prevent echoes and standing waves. In such an environment, the audience can feast their ears and experience an audio-visual feast. However, due to the limitation of the design principle, the thickness of Schroeder diffuser is in direct proportion to the length of sound waves. Thus, when diffusion requirements are put forward for low-frequency sound waves, the thickness size of Schroeder diffuser is inevitably very large. To solve this problem, the present invention discloses a broadband ultrathin acoustic wave diffusion structure in combination with the transformation acoustics theory developed in recent years.

SUMMARY

The present invention adopts the following technical solution:

The broadband ultrathin acoustic wave diffusion structure comprises a plurality of acoustic wave diffusion units. Each acoustic wave diffusion unit comprises at least one acoustic wave propagation section, and an acoustic wave focused section communicating with the acoustic wave propagation section is arranged according to needs.

The acoustic wave focused section is formed by a through cavity filled with acoustic material. The through cavity has variable section, and isotropic or anisotropic acoustic material is filled in the variable-section cavity. The anisotropic acoustic material is formed by embedding membranes or string nets into the isotropic acoustic material.

The acoustic wave propagation section is formed by a simply connected acoustic wave propagation passage with a close end.

In different acoustic wave diffusion units, simply connected acoustic wave propagation passages have different lengths. Some acoustic wave diffusion units have no acoustic wave focused section, and only comprise acoustic wave propagation sections. Some acoustic wave diffusion units comprise acoustic wave focused sections and acoustic wave propagation sections, and the through cavity of the acoustic wave focused section communicates with the simply connected acoustic wave propagation passages of the acoustic wave propagation sections. For the acoustic wave diffusion unit comprising the acoustic wave focused section and the acoustic wave propagation section, the simply connected acoustic wave propagation passage is closely arranged through the measures of circuitry, bending, coiling or stacking in a monolayer or multilayer or spatial spiral structural form, and occupies part or whole of available space of the broadband ultrathin acoustic wave diffusion structure.

For the acoustic wave diffusion unit comprising the acoustic wave focused section and the acoustic wave propagation section, the arrangement solutions of the simply connected acoustic wave propagation passage include:

(1) the simply connected acoustic wave propagation passage is closely arranged inside its own acoustic wave diffusion unit through the measures of circuitry, bending, coiling or stacking in a monolayer or multilayer or spatial spiral structural form, and occupies part or whole of available space outside the acoustic wave focused section; and (2) the simply connected acoustic wave propagation passage is closely arranged inside the broadband ultrathin acoustic wave diffusion structure through the measures of circuitry, bending, coiling or stacking in a monolayer or multilayer or spatial spiral structural form, occupies the whole of available space inside its own acoustic wave diffusion unit and also extends to other acoustic wave diffusion units to occupy the remaining available space inside other acoustic wave diffusion units, especially occupy the remaining space of the acoustic wave diffusion units with short simply connected acoustic wave propagation passages.

The membrane of the anisotropic acoustic material is a non-porous membrane or porous membrane, and is made of metal or nonmetallic, including cotton, fiber, silk, burlap, woolen cloth, mixture yarn and leather. The string net of the anisotropic acoustic material is made of metal or nonmetallic. The acoustic material is gas material, solid material or liquid material, including air, helium, gel, polyurethane, polyester, epoxy resin, foamed plastics, foamed metal, soft rubber, silicone rubber, butyl rubber, glass wool, glass fiber, felt, silk, cloth and micro-perforated panel.

Compared with a traditional Schroeder diffuser, the broadband ultrathin acoustic wave diffusion structure disclosed by the present invention is greatly different in both the design principle and the structure itself. An external acoustic wave enters the broadband ultrathin acoustic wave diffusion structure disclosed by the present invention. First, the acoustic wave is focused in the acoustic wave focused section. Then, the focused acoustic wave enters the acoustic wave propagation section, and propagates and reflects in the simply connected acoustic wave propagation passage. The simply connected acoustic wave propagation passage can be designed into a narrow and long passage according to needs through the close arrangement measures of circuitry, bending, coiling and stacking. In the broadband ultrathin acoustic wave diffusion structure disclosed by the present invention, the maximum length of the simply connected acoustic wave propagation passage may be dozens or even hundreds of times of the thickness of the acoustic wave diffusion structure, which can meet the diffusion requirements for low frequency acoustic waves to the maximum extent.

In the figures: 1 acoustic wave diffusion unit; 2 acoustic wave focused section; 3 acoustic wave propagation section; 4 acoustic material filled in acoustic wave focused cavity; 5 membrane or string net embedded in acoustic material; 6 wall of acoustic wave focused cavity; 7 isolated wall between simply connected acoustic wave propagation passages belonging to different acoustic wave diffusion units; 8 simply connected acoustic wave propagation passage; 9 wall of simply connected acoustic wave propagation passage; 10 communication hole between adjacent layers of laminated simply connected acoustic wave propagation passages.

The arrow in the figure indicates the direction of propagation of the acoustic wave, wherein a solid line with arrow indicates propagation of the acoustic wave in its own acoustic wave diffusion unit; and a dotted line with arrow indicates propagation of the acoustic wave from other acoustic wave diffusion units in the acoustic wave diffusion unit.

DETAILED DESCRIPTION

Embodiment 1

Figure 1:
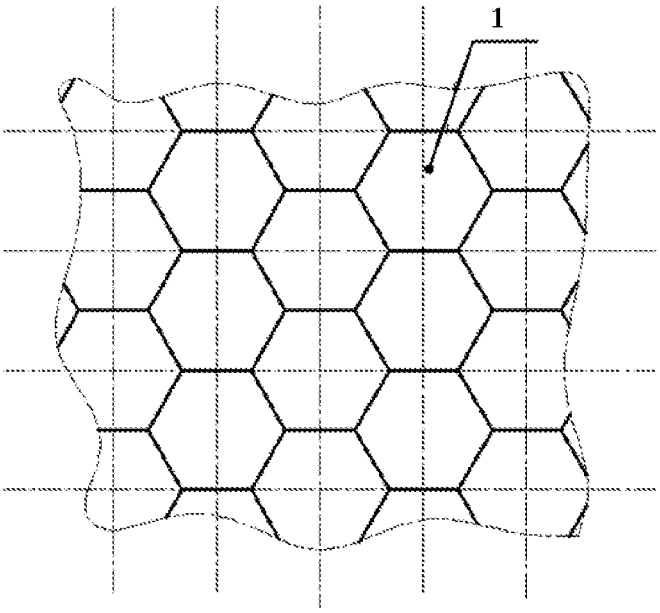
FIG. 1 is a schematic diagram of a main view of a broadband ultrathin acoustic wave diffusion structure.
Figure 2:
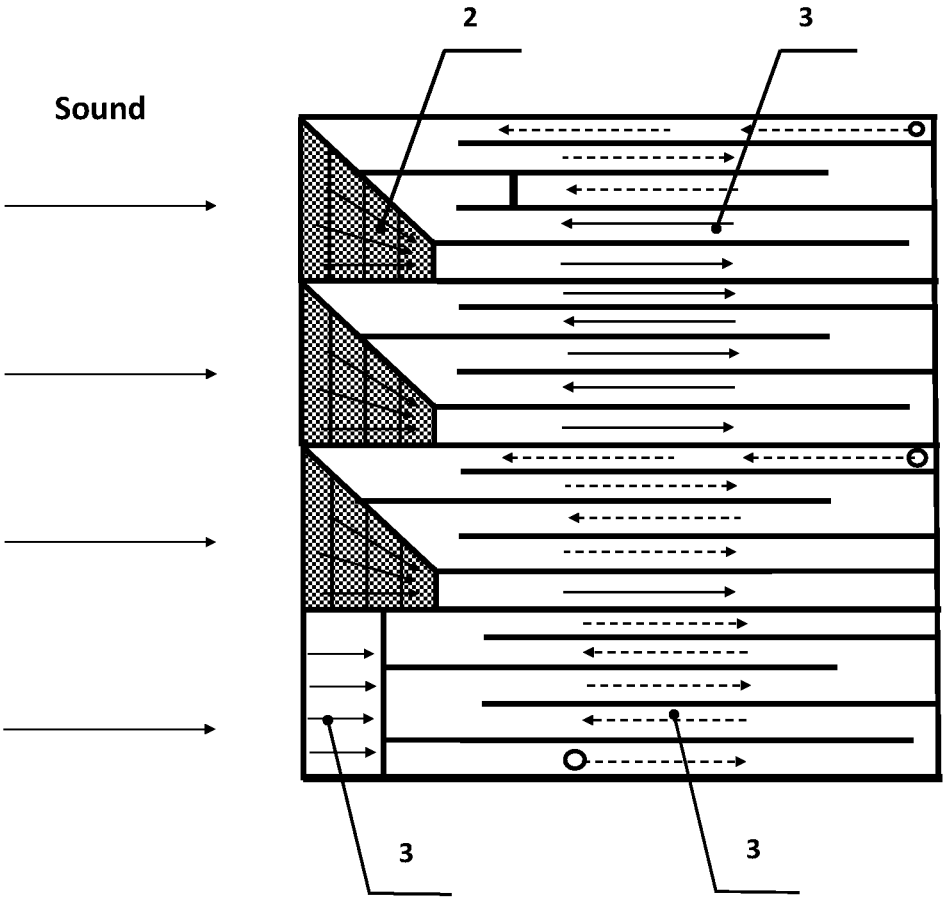
FIG. 2 is a schematic diagram of a side section of a broadband ultrathin acoustic wave diffusion structure.

A plurality of acoustic wave diffusion units are arranged along a body surface to form a broadband ultrathin acoustic wave diffusion structure, as shown in Figure and FIG. 2. Each acoustic wave diffusion unit 1 comprises at least one acoustic wave propagation section 3, and an acoustic wave focused section 2 communicating with the acoustic wave propagation section 3 is arranged according to needs.

Figure 6:
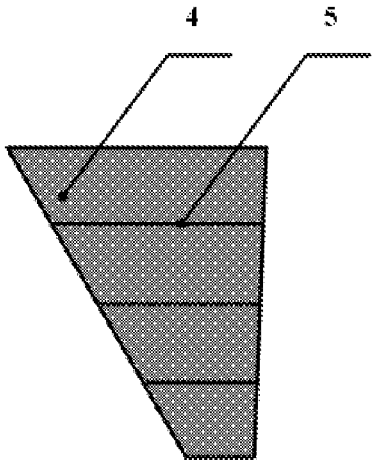
FIG. 6 is a sectional diagram of an acoustic wave focused section.

The acoustic wave focused section 2 is formed by a through cavity filled with acoustic material. The sectional diagram of the acoustic wave focused section 2 is shown in FIG. 6. The acoustic wave focused cavity is a variable-section cavity, and the end surface of the cavity is a hexagon. The acoustic material 4 is filled in the variable-section cavity, and multilayer membranes 5 are embedded at equal spacing in the variable-section cavity.

Figure 11:
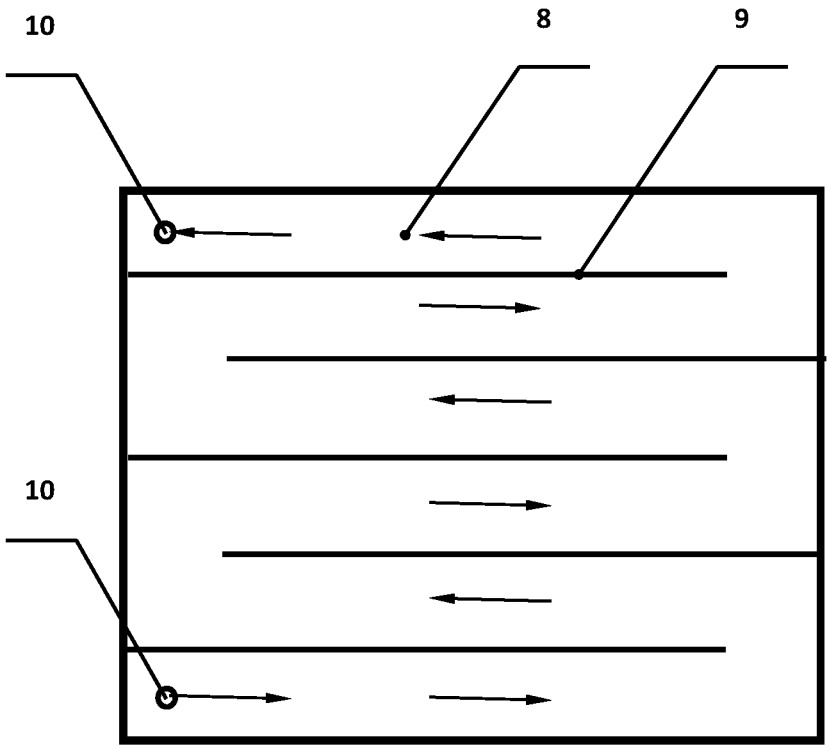
FIG. 11 is a monolayer schematic diagram of an acoustic wave propagation section.
Figure 12:
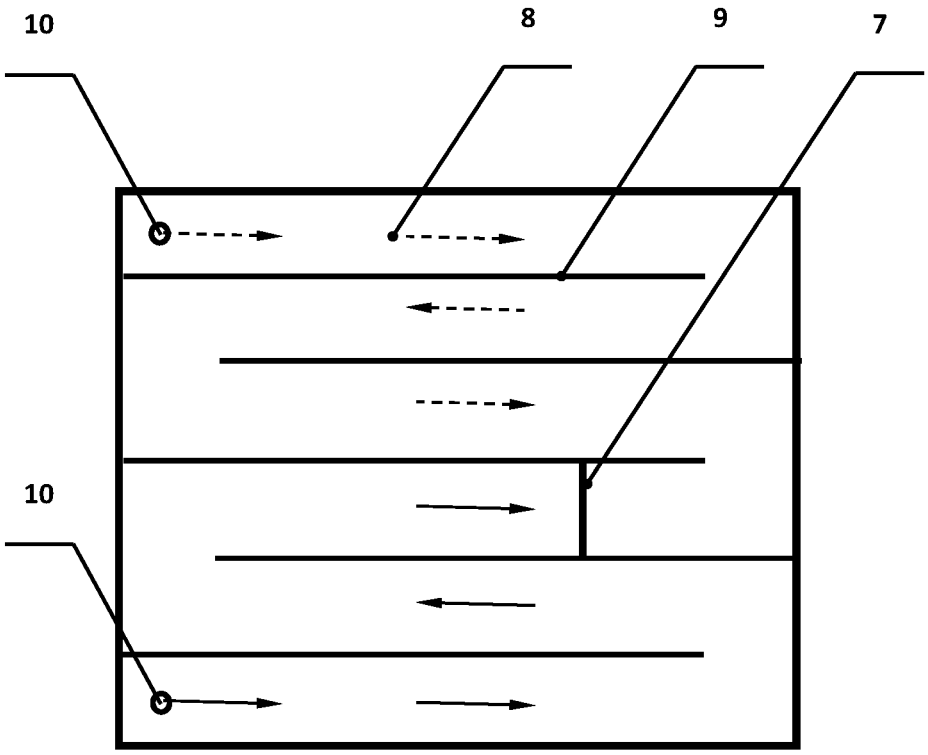
FIG. 12 is a monolayer schematic diagram of an acoustic wave propagation section.

The acoustic wave propagation section 3 is formed by a simply connected acoustic wave propagation passage 8 with a close end, and its monolayer schematic diagrams are shown in FIG. 11 and FIG. 12. Different acoustic wave diffusion units 1 have different lengths of the simply connected acoustic wave propagation passages 8.

Figure 5:
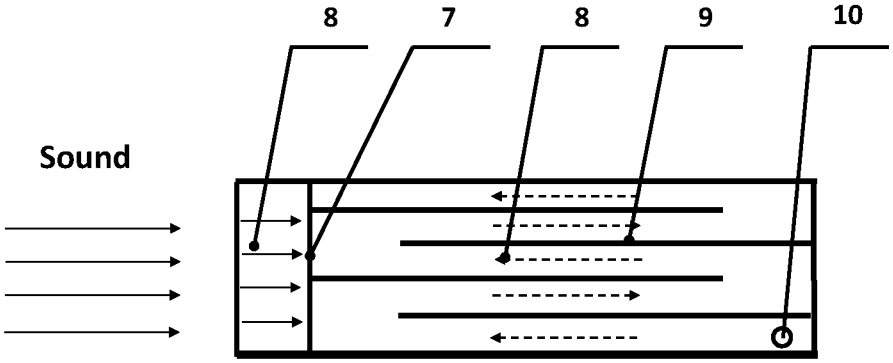
FIG. 5 is a schematic diagram of a side section of an acoustic wave diffusion unit.

In the broadband ultrathin acoustic wave diffusion structure, the arrangement solutions of the simply connected acoustic wave propagation passages 8 in different acoustic wave diffusion units are as follows:

(1) Some acoustic wave diffusion units 1 have no acoustic wave focused section 2, and only comprise the acoustic wave propagation sections 3, and their simply connected acoustic wave propagation passages 8 are short, as shown by a shallow cavity region occupied by the solid line with arrow in FIG. 5. The acoustic wave propagation sections 3 only occupy part of the available spaces of their own acoustic wave diffusion units 1.

Figure 3:
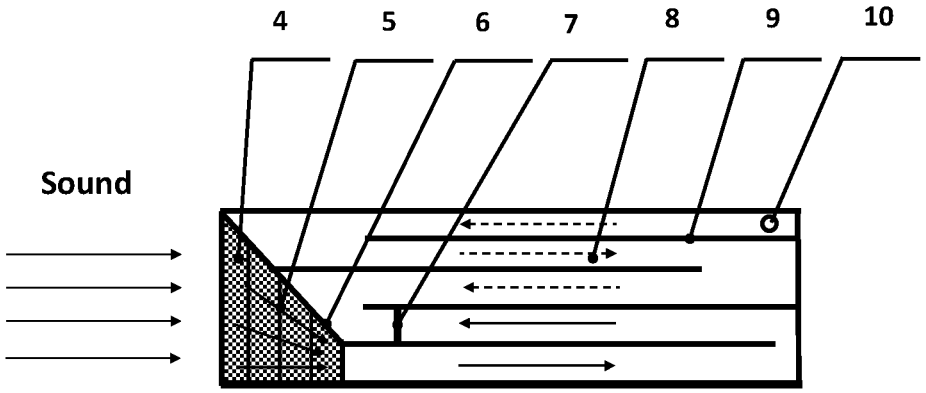
FIG. 3 is a schematic diagram of a side section of an acoustic wave diffusion unit.

(2) Some acoustic wave diffusion units 1 comprise the acoustic wave focused sections 2 and the acoustic wave propagation sections 3, and their simply connected acoustic wave propagation passages 8 are long. These simply connected acoustic wave propagation passages 8 are designed into narrow and long passages inside their own acoustic wave diffusion units by the measures of circuitry, bending, coiling or stacking in a monolayer or multilayer or spatial spiral structural form. The acoustic wave propagation sections 3 occupy part of available space of their own acoustic wave diffusion units 1, as shown by regions occupied by the solid lines with arrows in the acoustic wave propagation sections in FIG. 3 and FIG. 12. In the figure, 10 indicates a communication hole between adjacent layers of laminated simply connected acoustic wave propagation passages 8.

Figure 4:
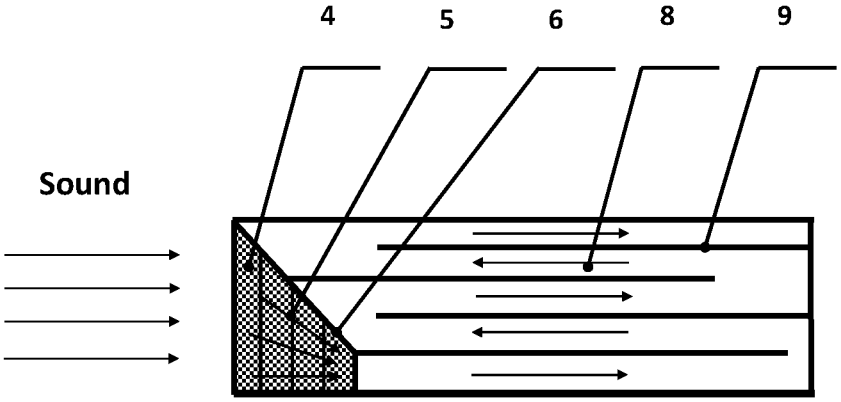
FIG. 4 is a schematic diagram of a side section of an acoustic wave diffusion unit.

(3) Some acoustic wave diffusion units 1 comprise acoustic wave focused sections 2 and acoustic wave propagation sections 3, and their simply connected acoustic wave propagation passages 8 are long. These simply connected acoustic wave propagation passages 8 are designed into narrow and long passages inside their own acoustic wave diffusion units by the measures of circuitry, bending, coiling or stacking inside the acoustic wave diffusion unit in a multilayer or spatial spiral structural form. The acoustic wave propagation sections 3 occupy the whole of available space of their own acoustic wave diffusion units 1, as shown in FIG. 4 and FIG. 11. In the figure, 10 indicates a communication hole between adjacent layers of laminated simply connected acoustic wave propagation passages 8.

(4) Some acoustic wave diffusion units 1 comprise acoustic wave focused sections 2 and acoustic wave propagation sections 3, and their simply connected acoustic wave propagation passages 8 are very long. These simply connected acoustic wave propagation passages 8 are designed into narrow and long passages inside the broadband ultrathin acoustic wave diffusion structure by the measures of circuitry, bending, coiling or stacking in a multilayer or spatial spiral structural form. These simply connected acoustic wave propagation passages 8 occupy the whole of available space of their own acoustic wave diffusion units and also extend to other acoustic wave diffusion units to occupy the remaining available space inside other acoustic wave diffusion units, especially occupy the remaining space of the acoustic wave diffusion units with short simply connected acoustic wave propagation passages 8, as shown in FIG. 2, FIG. 3, FIG. 5 and FIG. 12. The regions occupied by the dotted line with arrow indicate extension of the simply connected acoustic wave propagation passages 8 of other acoustic wave diffusion units in the acoustic wave diffusion unit. In the figure, 7 indicates an isolated wall between simply connected acoustic wave propagation passages 8 of this acoustic wave diffusion unit and another acoustic wave diffusion unit.

For the broadband ultrathin acoustic wave diffusion structure, first, external acoustic waves enter the acoustic wave focused section 2, and are focused by the variable-section cavity and the acoustic material filled therein. Then, the focused acoustic waves enter the acoustic wave propagation section 3, and propagate and reflect in the simply connected acoustic wave propagation passages 8. The maximum length of the simply connected acoustic wave propagation passage 8 may be dozens or even hundreds of times of the thickness of the broadband ultrathin acoustic wave diffusion structure.

Embodiment 2

Figure 7:
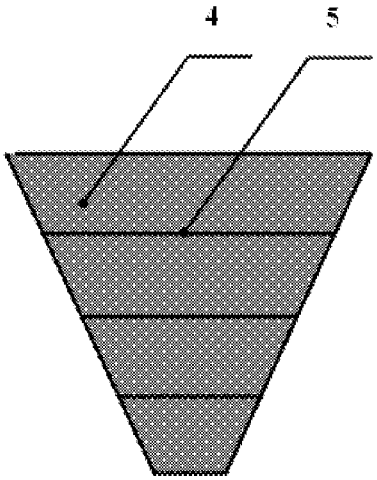
FIG. 7 is a sectional diagram of an acoustic wave focused section.
Figure 13:
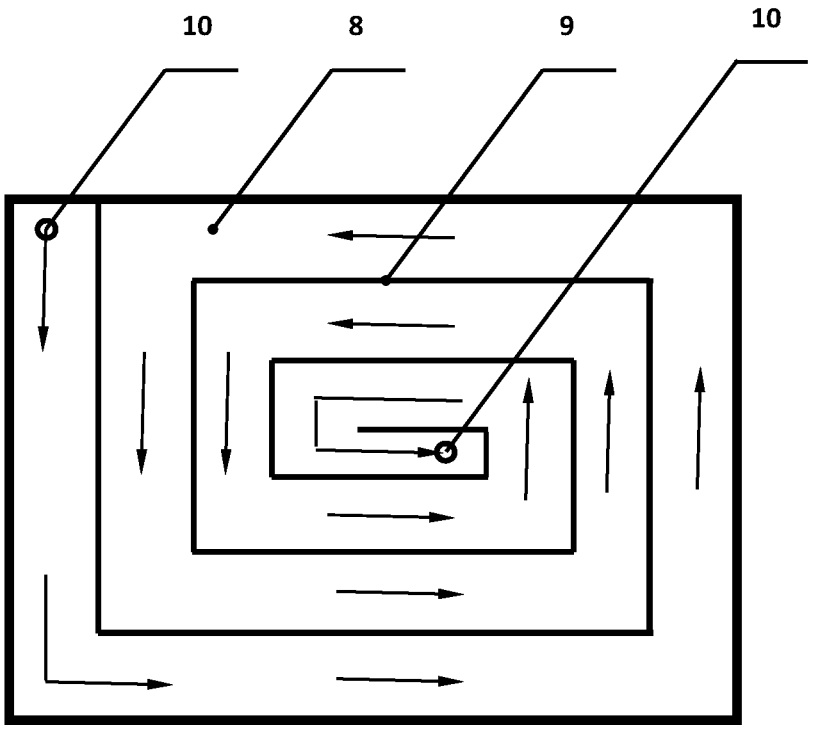
FIG. 13 is a monolayer schematic diagram of an acoustic wave propagation section.
Figure 14:
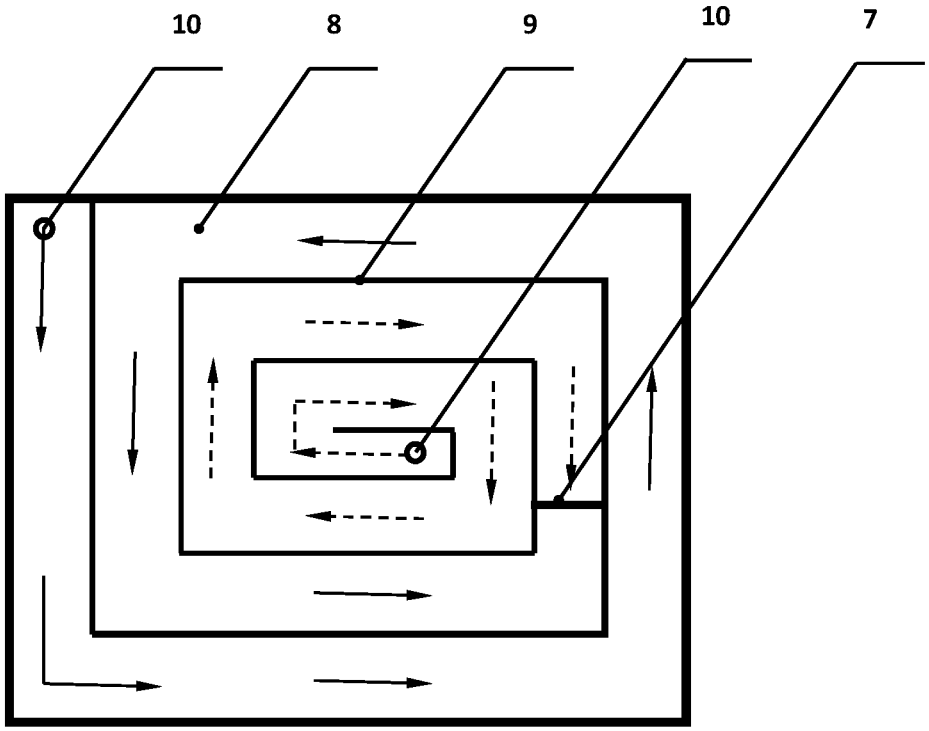
FIG. 14 is a monolayer schematic diagram of an acoustic wave propagation section.

The present embodiment is substantially the same as embodiment 1, and is different from embodiment 1 in that: (1) the cavity end surface of the acoustic wave focused section, as shown in FIG. 7, is a quadrangle. The acoustic material 4 is filled in the variable-section cavity, and multilayer fibers 5 are embedded at equal spacing in the cavity. (2) The monolayer schematic diagrams of the simply connected acoustic wave propagation passage 8 of the acoustic wave propagation section 3 are shown in FIG. 13 and FIG. 14.

Embodiment 3

Figure 8:
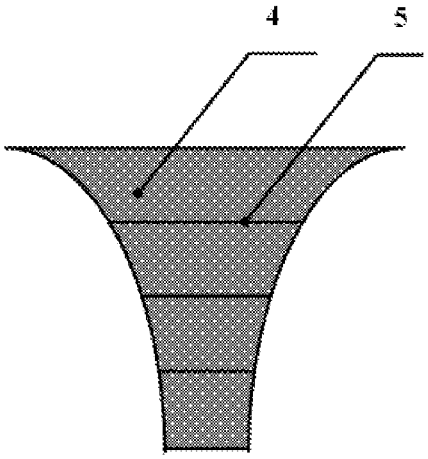
FIG. 8 is a sectional diagram of an acoustic wave focused section.
Figure 15:
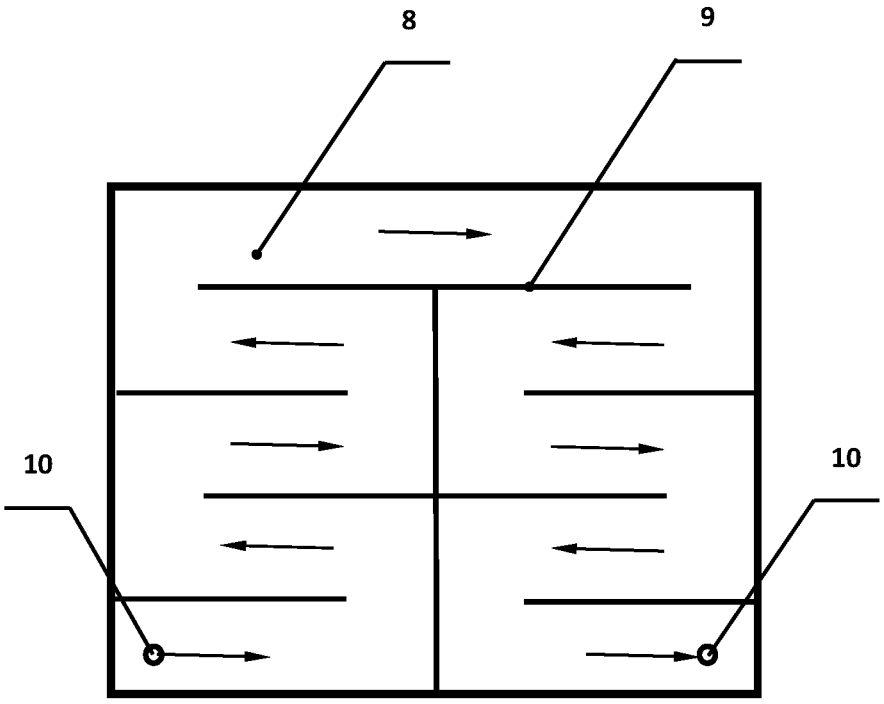
FIG. 15 is a monolayer schematic diagram of an acoustic wave propagation section.
Figure 16:
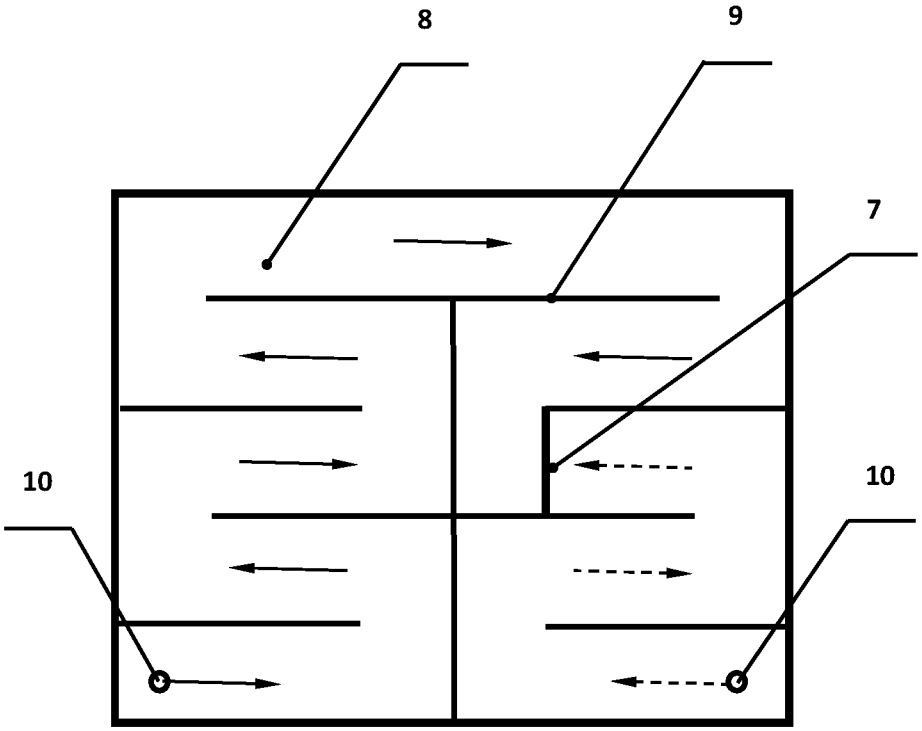
FIG. 16 is a monolayer schematic diagram of an acoustic wave propagation section.

The present embodiment is substantially the same as embodiment 1, and is different from embodiment 1 in that: (1) the cavity end surface of the acoustic wave focused section, as shown in FIG. 8, is a circle. The acoustic material 4 is filled in the variable-section cavity, and multilayer silks 5 are embedded at different spacings in the cavity. (2) The monolayer schematic diagrams of the simply connected acoustic wave propagation passage 8 of the acoustic wave propagation section 3 are shown in FIG. 15 and FIG. 16.

Embodiment 4

Figure 9:
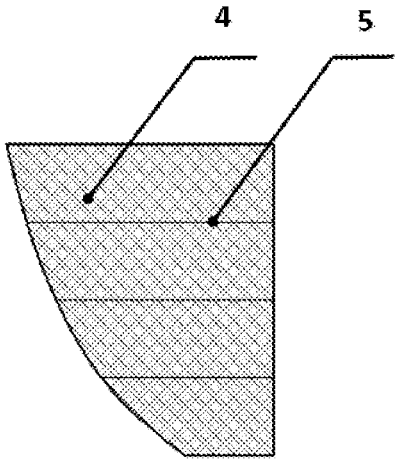
FIG. 9 is a sectional diagram of an acoustic wave focused section.

The present embodiment is substantially the same as embodiment 1, and is different from embodiment 1 in that: the cavity end surface of the acoustic wave focused section, as shown in FIG. 9, is a pentagon. The acoustic material 4 is filled in the variable-section cavity, and multilayer metal string nets 5 are embedded at equal spacing in the cavity.

Embodiment 5

Figure 10:
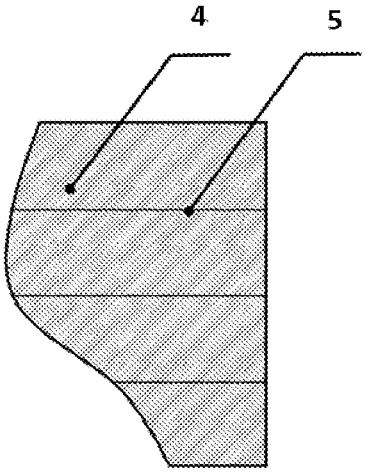
FIG. 10 is a sectional diagram of an acoustic wave focused section.

The present embodiment is substantially the same as embodiment 1, and is different from embodiment 1 in that: the cavity end surface of the acoustic wave focused section, as shown in FIG. 10, is an oval. The acoustic material 4 is filled in the variable-section cavity, and multilayer cloth 5 are embedded at different spacings in the cavity.

The invention claimed is:

1. A broadband ultrathin acoustic wave diffusion structure, comprising a plurality of acoustic wave diffusion units, wherein each acoustic wave diffusion unit comprises at least one acoustic wave propagation section, and an acoustic wave focused section communicating with the acoustic wave propagation section is arranged according to needs;

the acoustic wave focused section is formed by an acoustic wave focused cavity filled with acoustic material; the acoustic wave focused cavity is a variable-section cavity, and isotropic or anisotropic acoustic material is filled in the variable-section cavity;

the acoustic wave propagation section is formed by a simply connected acoustic wave propagation passage with a close end; and in different acoustic wave diffusion units, the simply connected acoustic wave propagation passages have different lengths; some acoustic wave diffusion units have no acoustic wave focused section, and only comprise the acoustic wave propagation sections; some acoustic wave diffusion units comprise acoustic wave focused sections and acoustic wave propagation sections, and the acoustic wave focused cavities of the acoustic wave focused sections communicate with the simply connected acoustic wave propagation passages of the acoustic wave propagation sections; for the acoustic wave diffusion unit comprising the acoustic wave focused section and the acoustic wave propagation section, the simply connected acoustic wave propagation passage of the acoustic wave propagation section is closely arranged through the measures of circuitry, bending, coiling or stacking in a monolayer or multilayer or spatial spiral structural form, and occupies part or whole of available space of the broadband ultrathin acoustic wave diffusion structure.

2. The broadband ultrathin acoustic wave diffusion structure of claim 1, wherein the anisotropic acoustic material is formed by embedding membranes or string nets into the isotropic acoustic material.

3. The broadband ultrathin acoustic wave diffusion structure of claim 1, wherein for the acoustic wave diffusion unit comprising the acoustic wave focused section and the acoustic wave propagation section, the arrangement solutions of the simply connected acoustic wave propagation passage of the acoustic wave propagation section include:

(1) the simply connected acoustic wave propagation passage is closely arranged inside its own acoustic wave diffusion unit through the measures of circuitry, bending, coiling or stacking in a monolayer or multilayer or spatial spiral structural form, and occupies the part or the whole of available space outside the acoustic wave focused section; and (2) the simply connected acoustic wave propagation passage is closely arranged inside the broadband ultrathin acoustic wave diffusion structure through the measures of circuitry, bending, coiling or stacking in a monolayer or multilayer or spatial spiral structural form, occupies the whole of available space inside its own acoustic wave diffusion unit and also extends to other acoustic wave diffusion units to occupy the remaining available space inside other acoustic wave diffusion units, especially occupy the remaining space of the acoustic wave diffusion units with short simply connected acoustic wave propagation passages.

4. The broadband ultrathin acoustic wave diffusion structure of claim 2, wherein for the acoustic wave diffusion unit comprising the acoustic wave focused section and the acoustic wave propagation section, the arrangement solutions of the simply connected acoustic wave propagation passage of the acoustic wave propagation section include:

(1) the simply connected acoustic wave propagation passage is closely arranged inside its own acoustic wave diffusion unit through the measures of circuitry, bending, coiling or stacking in a monolayer or multilayer or spatial spiral structural form, and occupies the part or the whole of available space outside the acoustic wave focused section; and (2) the simply connected acoustic wave propagation passage is closely arranged inside the broadband ultrathin acoustic wave diffusion structure through the measures of circuitry, bending, coiling or stacking in a monolayer or multilayer or spatial spiral structural form, occupies the whole of available space inside its own acoustic wave diffusion unit and also extends to other acoustic wave diffusion units to occupy the remaining available space inside other acoustic wave diffusion units, especially occupy the remaining space of the acoustic wave diffusion units with short simply connected acoustic wave propagation passages.

5. The broadband ultrathin acoustic wave diffusion structure of claim 2, wherein the membrane of the anisotropic acoustic material is a non-porous membrane or porous membrane, and is made of metal or nonmetallic, including cotton, fiber, silk, burlap, woolen cloth, mixture yarn and leather; and the string net of the anisotropic acoustic material is made of metal or nonmetallic.

6. The broadband ultrathin acoustic wave diffusion structure of claim 4, wherein the membrane of the anisotropic acoustic material is a non-porous membrane or porous membrane, and is made of metal or nonmetallic, including cotton, fiber, silk, burlap, woolen cloth, mixture yarn and leather; and the string net of the anisotropic acoustic material is made of metal or nonmetallic.

7. The broadband ultrathin acoustic wave diffusion structure of claim 1, wherein the acoustic material is gas material, solid material or liquid material, including air, helium, gel, polyurethane, polyester, epoxy resin, foamed plastics, foamed metal, soft rubber, silicone rubber, butyl rubber, glass wool, glass fiber, felt, silk, cloth and micro-perforated panel.

8. The broadband ultrathin acoustic wave diffusion structure of claim 2, wherein the acoustic material is gas material, solid material or liquid material, including air, helium, gel, polyurethane, polyester, epoxy resin, foamed plastics, foamed metal, soft rubber, silicone rubber, butyl rubber, glass wool, glass fiber, felt, silk, cloth and micro-perforated panel.

9. The broadband ultrathin acoustic wave diffusion structure of claim 3, wherein the acoustic material is gas material, solid material or liquid material, including air, helium, gel, polyurethane, polyester, epoxy resin, foamed plastics, foamed metal, soft rubber, silicone rubber, butyl rubber, glass wool, glass fiber, felt, silk, cloth and micro-perforated panel.

10. The broadband ultrathin acoustic wave diffusion structure of claim 4, wherein the acoustic material is gas material, solid material or liquid material, including air, helium, gel, polyurethane, polyester, epoxy resin, foamed plastics, foamed metal, soft rubber, silicone rubber, butyl rubber, glass wool, glass fiber, felt, silk, cloth and micro-perforated panel.

11. The broadband ultrathin acoustic wave diffusion structure of claim 5, wherein the acoustic material is gas material, solid material or liquid material, including air, helium, gel, polyurethane, polyester, epoxy resin, foamed plastics, foamed metal, soft rubber, silicone rubber, butyl rubber, glass wool, glass fiber, felt, silk, cloth and micro-perforated panel.

12. The broadband ultrathin acoustic wave diffusion structure of claim 6, wherein the acoustic material is gas material, solid material or liquid material, including air, helium, gel, polyurethane, polyester, epoxy resin, foamed plastics, foamed metal, soft rubber, silicone rubber, butyl rubber, glass wool, glass fiber, felt, silk, cloth and micro-perforated panel.

* * * * *